United States Patent [19]

Lo Cascio

[11] 4,356,809

[45] Nov. 2, 1982

[54] AUTOMOTIVE STALL CIRCUIT

[75] Inventor: James J. Lo Cascio, Mesa, Ariz.

[73] Assignee: Motorola, Inc., Schaumburg, Ill.

[21] Appl. No.: 269,118

[22] Filed: Jun. 1, 1981

[51] Int. Cl.[3] ..... F02P 11/00

[52] U.S. Cl. ..... 123/632; 123/146.5 D

[58] Field of Search ..... 123/146.5 D, 609, 632, 123/644; 307/549, 551, 559, 561

[56] References Cited

U.S. PATENT DOCUMENTS 3,937,193 2/1976 Kim ..... 123/632 X 4,100,907 7/1978 Davis et al. ..... 123/620

4,106,460 8/1978 Kopera ..... 123/632 X 4,275,701 6/1981 Arguello et al. ..... 123/609

*Primary Examiner*—Tony M. Argenbright

*Attorney, Agent, or Firm*—Michael D. Bingham

[57] ABSTRACT

A stall circuit is described for use in combination with an electronic adaptive dwell ignition system which allows an ignition coil to be de-energized whenever the frequency of operation of the ignition system decreases below a specified frequency without causing a spark to be generated in the engine of an automobile controlled by the ignition system while allowing continued operation of the ignition system to generate a spark in response to a spark command being generated with minimum spark retard.

10 Claims, 3 Drawing Figures

AUTOMOTIVE STALL CIRCUIT

BACKGROUND OF THE INVENTION

1. Field of the Invention

This invention relates to an automotive stall circuit to de-energize an ignition coil in an automotive ignition system whenever the automotive engine rpm is below a predetermined operating frequency. More particularly, the stall circuit provided de-energization of the coil at the stall frequency without causing causing spark to the engine yet allowing operation of the engine and the ignition system to produce spark below the stall frequency.

2. Description of the Prior Art

It is necessary, in a high-energy adaptive dwell electronic ignition system comprising an integrated circuit, an ignition coil and discrete power circuitry as is generally known to those skilled in the art, to shut down the ignition system whenever the engine speed decreases below a predetermined stall frequency in order to protect the coil and discrete power circuitry. During normal engine operation the adaptive dwell ignition system controls the amount of power that is dissipated in the coil and power circuitry. However, at engine speeds below the stall frequency, e.g., one hertz, the time between successive engine sparking is great enough to allow excessive power dissipation in the coil and discrete power device which could very well damage or destroy either the coil or the power circuitry or both. Hence, almost all contemporary high energy adaptive dwell electronic systems have some type of stall circuit associated therewith to cause shutdown of the ignition system at the stall frequency to prevent damage of the coil and the power circuitry. For example, U.S. Pat. No. 4,100,907 as well as commonly assigned U.S. patent application, Ser. No. 253,423 entitled "START TO RUN CIRCUIT FOR AN ELECTRONIC IGNITION SYSTEM", describe an adaptive dwell ignition system having stall circuits for shutting down of the ignition system at engine rpm's below a predetermined speed.

A problem with some prior art stall circuits is that once the stall circuit de-energizes the coil, the ignition system is rendered inoperative until the engine is restarted by turning the key in the ignition switch. Thus, these prior art ignition systems do not continue to operate below the stall frequency to continue to produce engine spark therebelow. This prevents push starting of a stalled automobile including the type of ignition systems as aforedescribed.

Therefore, a need exists for a stall circuit for softly de-energizing the ignition coil of an automobile at the stall frequency to prevent a spark from being generated yet allowing the engine and ignition system to operate below this frequency to provide correct engine spark with a minimum amount of spark retard.

SUMMARY OF THE INVENTION

Accordingly, it is an object of the present invention to provide an improved automotive stall circuit for use with an electronic ignition system.

Another object of the present invention is to provide an improved automotive stall circuit for de-energizing an ignition coil when the engine rpm is below a predetermined frequency.

Yet another object of the present invention is to provide an improved automotive stall circuit for use with electronic ignition systems to de-energize the ignition coil whenever the engine rpm decreases below a predetermined stall frequency while preventing a spark yet allowing the ignition system to continue to generate spark whenever the engine rpm is below the predetermined frequency in accordance to spark command signals being generated.

In accordance with the above and other objects there is provided an automotive stall circuit for use with an adaptive dwell ignition system for controlling the amount of current in an ignition coil and external power circuitry under normal engine operation which comprises a charge storage device which is normally charged and discharged by the ignition system during normal engine operation such that the potential developed thereacross is maintained greater than a predetermined reference potential, a first unity gain follower coupled to the charge storage device for supplying a potential at the output thereof substantially equal to the potential developed across the charge storage device, diode switching means coupled between the output of the first unity gain follower and the reference potential, a second unity gain follower coupled between the reference potential and having an output, and a comparator having an output coupled to the external power circuitry and first and second inputs, the first input being coupled to the output of the second unity gain follower and the second input being coupled to the power circuitry for sensing a voltage potential derived from the current flowing through the power circuitry, the stall circuit being responsive to the potential across the charge storage device being greater than the reference potential for allowing the power circuitry to be rendered conductive in accordance with the adaptive dwell ignition system and the stall circuit being responsive to the potential across the charge storage device decreasing below the reference potential caused by the engine rpm decreasing below a predetermined stall frequency whereby the ignition coil is softly de-energized to prevent a spark from being produced therefrom.

DETAILED DESCRIPTION OF THE INVENTION

Figure 1:
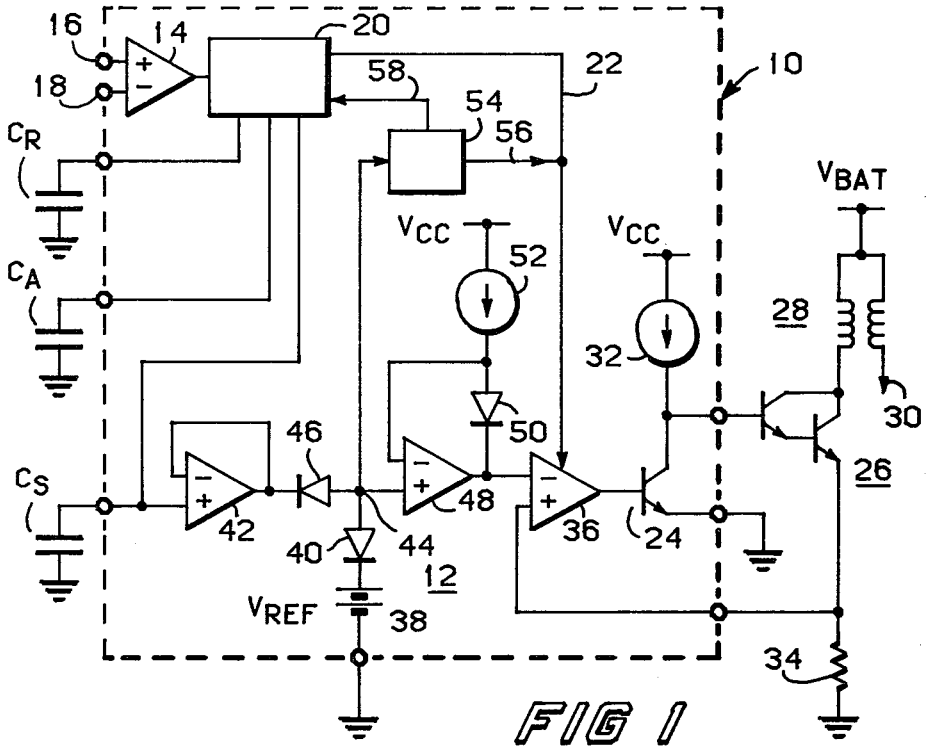
FIG. 1 illustrates in partial block and schematic diagram form an electronic ignition system including a stall circuit of the present invention.

Turning to FIG. 1, there is illustrated electronic adaptive dwell ignition system 10 the operation of which is generally known to those skilled in the art. Ignition system 10 includes stall circuit 12 of the present invention and is suitable to be manufactured in integrated circuit form as indicated by the dashed outline form. Ignition system 10 comprises comparator 14 adapted to receive timing signals at inputs 16 and 18 that are generated in timed relationship to the engine rpm of an internal combustion engine which is coupled thereto. In response to the timing signals, comparator 14, having hysteresis, produces a substantially square wave output signal which is applied to the input of a low current dwell circuit 20. Dwell circuit 20 produces a quarter cycle pulse in response to the signal received from comparator 10 and additionally causes capacitor CR to be first discharged in response to the timing signals crossing a zero voltage axis in a positive direction for approximately the first 25% of each firing cycle period of operation of the ignition system and then causes the capacitor to be charged during the remaining 75% of the firing cycle time period (FIG. 2A). Concurrent with capacitor CR being discharged, dwell circuit 20, via lead 22 and comparator 36 renders a transistor switching circuit, which is represented by transistor 24, conductive to render external power amplifier stage 26 non-conductive which in turn causes ignition coil 28 to be discharged or de-energized in response to the spark command signal generated whenever the timing signals cross a zero axis in a positive sense. Discharging of coil 28 produces a spark at output 30 to operate the engine. Adaptive dwell capacitor CA is discharged at the initiation of each firing cycle at a predetermined rate until a previous predetermined threshold level value is reached. Thereafter, the value of the potential across capacitor CA is held substantially constant until such time that the current through ignition coil is caused to be limited when the potential thereacross is ramped up at a second rate until initiation of the next firing cycle. Dwell circuit 20 causes current to ramp or flow through ignition coil 28 whenever the value of the potential across capacitor CR exceeds the potential value across the adaptive dwell capacitor CA as is understood. Current through ignition coil 28 is limited whenever the current value through sense resistor 34 causes a voltage potential thereacross to exceed the potential value appearing at the inverting input of comparator 36. Typically, the current magnitude when limiting occurs is equal to six amps. As is generally understood, the level of the threshold voltage developed across capacitor CA is caused to vary according to engine rpm whereby the amount of the power dissipated in power amplifier 26 and ignition coil 28 is controlled. The operation of the aforedescribed ignition system is well known and is described in both U.S. Pat. No. 4,100,907 and U.S. patent application Ser. No. 253,423.

A problem arises in ignition system 10 as the engine rpm decreases. At some predetermined engine rpm, for example one hertz, the power dissipated in power ampliiier 26 and ignition coil 28 could become excessive to the point of damaging or, even worse, destroying either the amplifier or the coil or both. Thus, most high-energy ignition systems of the type being described include means for sensing when the frequency of operation reaches a predetermined frequency, generally referred to as the stall frequency, to cause de-energization of the coil so that neither the coil nor the power amplifier can be damaged. However, some contemporary stall circuits, although de-energizing the coil without causing a spark which otherwise could cause a misfire that could damage the engine, do not allow continued operation of the ignition system, i.e., the engine is shut down until the key is turned in the ignition switch. Hence, automobiles with these types of stall circuits cannot be push started once stalled or when the battery voltage is too low to allow starting by the ignition switch.

Stall circuit 12 of the present invention provides de-energizing of ignition coil 28 without producing spark while allowing continued operation of the ignition system to generate retarded spark below the stall frequency.

Figure 2:
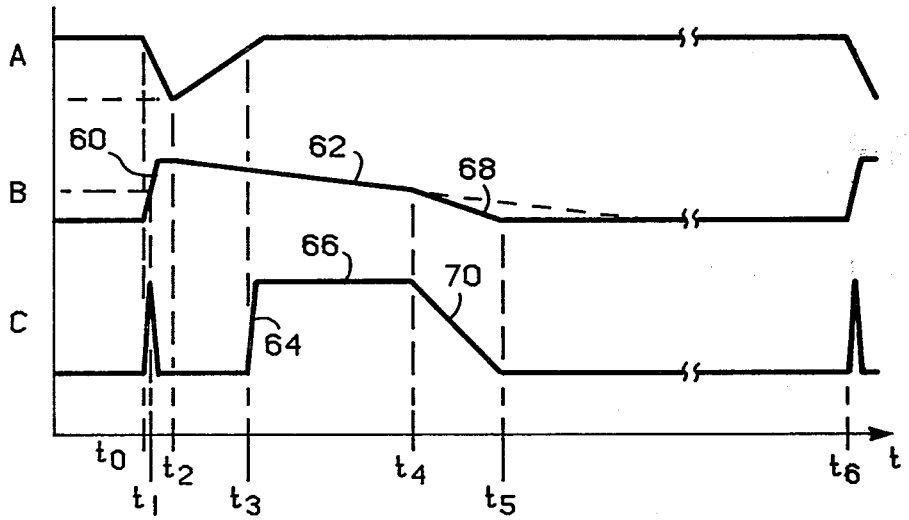
FIG. 2 illustrates waveforms useful for understanding the operation of the present invention.

With reference to FIG. 2, the operation of stall circuit 12 can be explained. As known, stall capacitor CS is first charged to a predetermined voltage potential at the initiation of each firing cycle period waveform 60 of FIG. 2B and then discharged at a predetermined rate by dwell circuit 20 in response to discharging capacitor CR portion 62 of FIG. 2B. The above referenced patent application, the teachings of which are incorporated herein by reference, discloses a manner of charging and discharging the stall capacitor. Thus, in normal operation, engine rpm above the stall frequency, stall capacitor CS is never allowed to be discharged below the potential $kV_{ref}$, where $V_{ref}$ is a reference potential supplied by reference source 38 and k is the a predetermined gain factor which may be one or less for instance. Comparator 42, which is connected in a unity gain follower configuration, causes the potential value appearing across capacitor CS to appear at the output thereof to maintain diode 46 in a reverse biased state since the potential across capacitor CS is normally greater than the potential appearing at node 44. Comparator 48, which is also connected in a unity gain follower configuration via diode 50 and current source 52, produces a potential $V_{ref}$ to the inverting input of comparator 36. Therefore, in normal operation, dwell circuit 20 in response to the ignition timing signals renders transistor 24 first conductive and then nonconductive to discharge and then charge ignition coil 28. Ignition coil 28 is charged prior to being discharged at the initiation of each firing cycle by transistor 24 being rendered nonconductive which allows current source 32 to supply base current drive to power amplifier 26. Current thus ramps up through ignition coil 28 until the voltage produced across sense resistor 34 becomes substantially equal in magnitude to $V_{ref}$. Subsequently, comparator 36 produces an output to render transistor 24 conductive to limit the current through coil 28 at a value corresponding to the voltage $V_{ref}$. Typically, the coil current at limiting is equal to six amps.

To explain the operation of stall circuit 12 of the present invention it is assumed that the engine rpm has decreased below the specified stall frequency prior to time $t_0$ (FIG. 2) such that the potential VCS across stall capacitor CS is at or near ground reference (FIG. 2B). In this state of operation, diode 46 is forward biased which enables circuit 54 and an output signal is provided at output 56 which prevents the output of dwell circuit 20 via lead 22 from controlling the operation of the circuit. Simultaneously, the level of the input signal supplied to the inverting input of comparator 36 is caused to follow the potential appearing across stall capacitor CS as diode 46 is forward biased whereby the power amplifier circuitry 26 is shut down to inhibit coil current. However, at time $t_0$, in response to timing signals supplied to input terminal 16 and 18 generating a spark command signal, dwell circuit 20 quickly charges stall capacitor CS to its maximum level $V_{max}$ as shown by wave form portion 60 of FIG. 2. Because the output of comparator 48 follows the potential appearing across the stall capacitor, the current through ignition coil 28 is allowed to ramp upwards in accordance with the stall capacitor being charged until time $t_1$ when the potential across the stall capacitor reverse biases diode 46. At this time, the potential level appearing at the non-inverting input of comparator 36 is equal to $V_{ref}$ and the current through the ignition coil 28 is equal to its maximum value, $I_{coil}$, as shown in FIG. 2. As soon as diode 46 is reverse biased, at time $t_1$, circuit 54 is disabled which allows dwell circuit 20 to quickly cause discharge of the ignition coil. At time $t_2$ capacitor CR has been fully discharged to $V_{min}$, FIG. 2, and stall capacitor CS is then caused to be discharged at a predetermined rate, waveform portion 62, by dwell circuit 20 as previously discussed. At time $t_3$ dwell circuit 20 renders transistor 24 nonconductive to allow current to ramp up through ignition coil 28 (waveform portion 64 of FIG. 2). The current through ignition coil 28 ramps upwards until being limited by comparator 36 as previously described; waveform portion 66. Stall capacitor CS is continued to be discharged by dwell circuit 20 until time $t_4$ when the potential appearing thereacross has decreased to the point where diode 46 is rendered forward biased. At this time, circuit 54 is again enabled to both disable the output dwell circuit 20 as already discussed as well as producing an output signal at output 58 which causes stall capacitor CS to be discharged at a different rate as shown by waveform portion 68. Hence, transistor 24 is rendered more conductive at the same rate as the stall capacitor is discharged which in turn causes the ignition coil 28 to be deenergized at the same rate that the stall capacitor is discharged, waveform portion 70, until time $t_5$ when the ignition coil is fully discharged. The rate that ignition coil 28 is caused to be discharged between time intervals $t_4$ and $t_5$ is not sufficient to create spark in the ignition coil. Although the stall capacitor is shown as being discharged at a different rate at time $t_4$ it should be realized that if the rate of discharge of the capacitor between time interval $t_2$–$t_4$ is sufficient to allow the capacitor to be completely discharged before the next firing spark command at time $t_6$ without causing a spark to be generated in ignition coil 28 that a second discharge rate need not be required. Hence, capacitor CS could be discharged at rate shown by the dashed line in FIG. 2. At time $t_6$, in response to the next spark command when capacitor CR is discharged, the stall capacitor is again quickly charged to produce a delayed spark. Therefore, as described, the stall circuit 12 de-energizes the ignition coil without generating a spark whenever the engine RPM decreases below a specified stall frequency while allowing a controlled amount of spark retard. This allows an automobile incorporating the ignition system 10 of the present invention to be push started at a frequency below the stall frequency.

Figure 3:
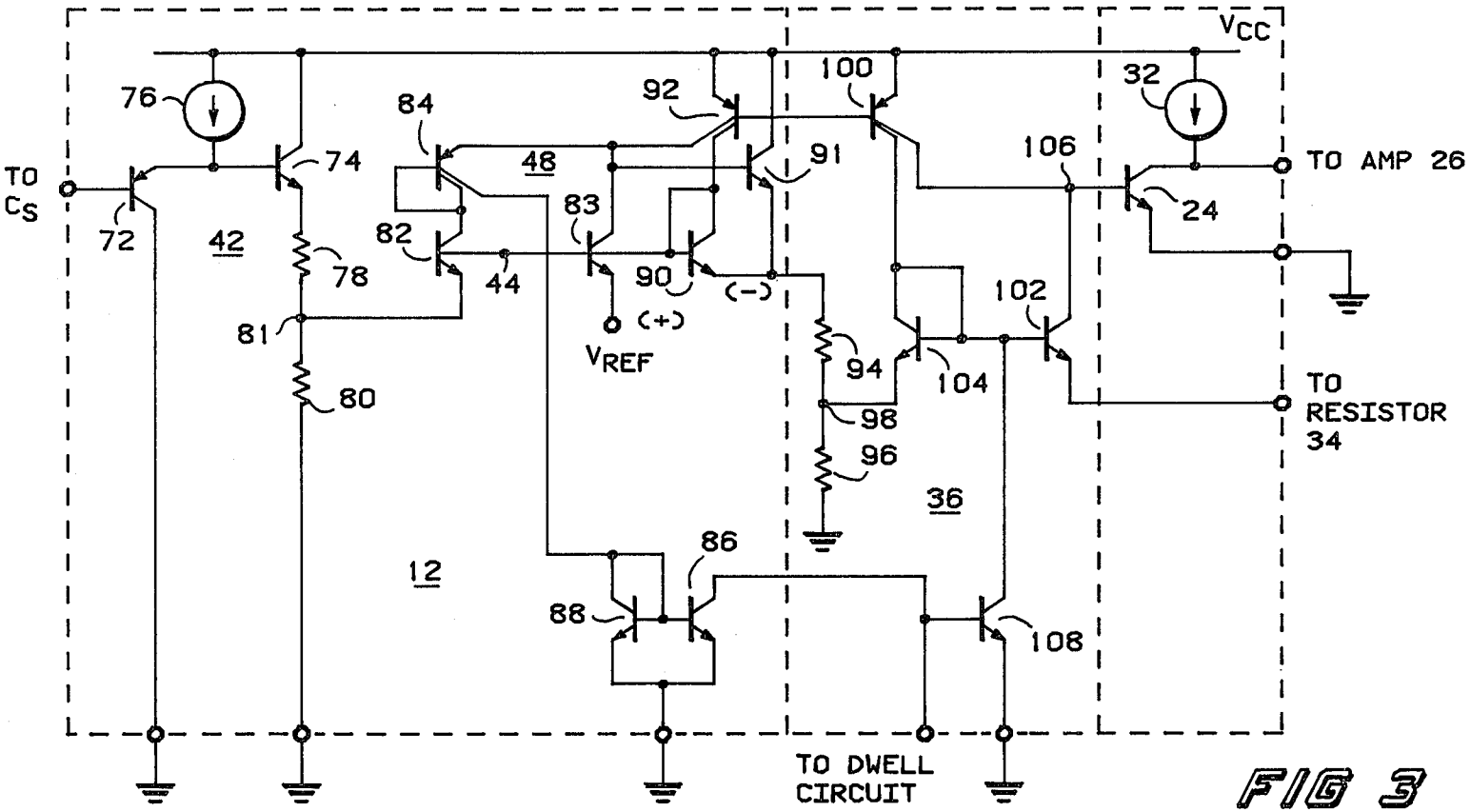
FIG. 3 shows a schematic diagram of the preferred embodiment of the present invention.

Turning to FIG. 3 there is shown stall circuit 12 of the preferred embodiment as well as comparator 36. Comparator 42 is realized by transistors 72, 74 and current source 76 as well as the resistor divider network comprising resistors 78 and 80. Transistors 72 and 74 are always maintained in a conductive state such that the voltage appearing at the emitter of transistor 74 follows the voltage appearing across capacitor CS. Hence, the operation of comparator 42 is such that with the potential across stall capacitor CS being greater than $kV_{ref}$ a voltage is produced at node 81 which reverse biases the emitter junction of transistor 82 of comparator 48. Thus, transistor 82 is rendered nonconductive which in turn maintains multi-collector transistor 84, transistor 86 and diode connected transistor 88 nonconductive and the ignition system responds to dwell control signals supplied to the base of transistor 108 as aforedescribed to charge and discharge ignition coil 28. Comparator 36 is shown as including current sourcing transistor 100, transistor 102 and diode connected transistor 104 wherein the emitter electrodes of these two devices serve as the non-inverting and inverting inputs respectively of comparator 36. The output of comparator 36 is taken at node 106 and is connected to the base electrode of transistor 24 as aforedescribed.

In operation, responsive to a spark command signal from dwell circuit 20, transistor 108 is rendered conductive at the beginning of each firing cycle period which shuts off transistor 102 to allow transistor 24 to be rendered conductive to cause discharge of ignition coil 28. After the first twenty-five percent of the firing cycle, current is allowed to ramp through ignition coil 28 in response to dwell circuit 20 rendering transistor 108 nonconductive. Thus, after transistor 108 is rendered nonconductive the current mirror comprising transistors 102 and diode connected transistor 104 are rendered operative whereby transistor 102 remains saturated until such time that the potential across resistor 34 becomes essential equal to the voltage appearing at node 98. As long as transistor 102 is in a saturated state, transistor 24 is rendered nonconductive allowing current to be sourced to ignition coil 28 from current source 32. As the potential across resistor 34 reaches the value of the voltage appearing at node 98, transistor 102 can no longer be maintained in a saturated state as the current mirror is balanced whereby transistor 24 is rendered conductive in a linear fashion to limit the current through ignition coil 28.

Whenever the engine rpm decreases below the stall frequency the voltage across stall capacitor CS decreases below $kV_{ref}$ transistor 82 is no longer reverse biased since the base voltage which is equal to $V_{ref}$ plus the base-emitter voltage of transistor 83 is then greater than $V_{81}$, the voltage at node 81. When this happens transistor 82 is rendered conductive to sink current from transistor 92 and in turn renders transistor 86 conductive to turn off transistor 108. Transistor 91 is rendered non-conductive by transistor 84 sinking current from current source transistor 92 to cause the voltage at the output of the comparator and hence at node 98 to decrease until the voltage at node 98 substantially equals the voltage appearing at node 81 which is proportional to $V_{CS}$. As will later be explained, as $V_{98}$ (the voltage appearing at node 98) decreases linearly in response to capacitor CS being discharged linearly, the current through ignition coil 28 is caused to decrease in a linear manner. Additionally, with transistor 86 being conductive, any output from dwell circuit 20 to the base of transistor 108 has no affect on the operation of the ignition system. However, as long as the engine rpm is below the stall frequency, stall circuit 12 allows a spark to be generated in response to each spark command signal applied to the ignition system with a minimum amount of spark retard. Thus, as stall capacitor CS is rapidly charged at the initiation of each firing cycle by dwell circuit 20, the voltage at node 81 is caused to increase at the same rate which causes voltage at node 98 to increase accordingly. As node 98 becomes higher in voltage, devices 102 and 104 allow more coil current to ramp upwards until such time that stall capacitor CS is charged to a potential substantially equal to $kV_{ref}$. Thereafter, as previously explained, because the potential across stall capacitor CS is equal to or greater than $kV_{ref}$, a proportional voltage is developed across node 98 which allows maximum current of approximately 6 amperes to flow through the ignition coil. As soon as maximum current has been reached through ignition coil which coincides with stall capacitor CS being charged to a potential equal to $kV_{ref}$ transistor 86 is rendered nonconductive. This allows the output from dwell circuit 20 to render transistor 108 conductive to immediately discharge the coil at time $t_1$ (FIG. 2C).

At time $t_3$, in response to an ignition system 10 turning on coil current, the ignition coil is charged (portions 64 and 66 of FIG. 2C) accordingly. However, with the engine rpm being less than the stall frequency, capacitor CS is discharged at time $t_4$ wherein $V_{81}$ reaches $V_{ref}$ which turns on transistor 82. Thereafter, as capacitor CS is discharged, portion 68 of FIG. 2B, the voltage at node $V_{98}$ decreases at the same rate due to transistor 91 being rendered non-conductive proportionally to the rate of decrease in $V_{81}$ which causes the current through ignition coil to decrease proportionally by the aforedescribed action of the current mirror formed by transistors 104 and 102.

Hence, what has been described above, is a novel stall circuit for use in combination with an electronic adaptive dwell ignition system which allows de-energization of an ignition coil without producing a spark whenever the engine rpm decreases below a specified stall frequency while allowing operation of the ignition system to generate spark below the stall frequency. This allows an automobile to be push started at a frequency well below the stall frequency.

I claim:

1. A stall circuit to be utilized in combination with an adaptive dwell electronic ignition system operated in timed relationship to an engine, comprising:

first circuit means coupled to a first circuit node for providing a reference potential thereat; and second circuit means having an input coupled with the ignition system and an output which is responsive to the magnitude of an input signal supplied thereto being greater than said reference potential for producing an output signal the magnitude of which is proportional to said reference potential, said second circuit means being responsive to said magnitude of said input signal being less than said reference potential for producing an output signal that is proportional to said magnitude of said input signal.

2. The stall circuit of claim 1 wherein said second circuit means includes:

first unity gain follower means having an input and an output, said input being said input of said second circuit means, said first unity gain follower means producing an output signal the magnitude of which is proportional to the magnitude of said input signal supplied thereto, and first diode means coupled between said output of said first unity gain follower means and said first circuit node, said first diode being reverse biased whenever said input signal magnitude is greater than said reference potential by a predetermined amount and being forward biased whenever said input signal magnitude is less than said reference potential.

3. The stall circuit of claim 2 wherein said second circuit means further includes second unity gain follower means coupled between said first circuit node and said output of said second circuit means for producing said output signal.

4. The stall circuit of claim 2 or 3 wherein said first circuit means includes:

a potential source for providing a fixed potential at an output thereof; and diode means coupled between said output of said potential source and said first circuit node.

5. In an adaptive dwell ignition system including a dwell circuit for generating control signals in response to receiving timing signals supplied thereto that are generated in timed relationship to an engine rpm, current limiting circuitry responsive to the control signals for producing current to charge and then discharge an ignition coil accordingly, a stall circuit comprising:

first unity gain comparator means having an input coupled with the dwell circuit and receiving an input signal the magnitude of which is controlled by the dwell circuit, said first unity gain comparator means providing an output signal at an output the magnitude of which is proportional to said input signal magnitude;

first diode means coupled between said output of said first unity gain comparator means and a first circuit node;

first circuit means coupled to said first circuit node for producing a reference potential thereat; and second unity gain comparator means having an input coupled to said first circuit node and an output coupled to an input of the current limiting circuit, said second unity gain comparator means being responsive to said magnitude of said output signal of said first unity gain comparator means being less than said reference potential by a predetermined amount for producing an output signal the magnitude of which is proportional to said magnitude of said output signal of said first unity gain comparator means and being responsive to said magnitude of said output signal of said first unity gain comparator means being greater than said reference potential for producing an output signal the magnitude of which is proportional to said reference potential.

6. The stall circuit of claim 5 wherein said first unity gain comparator means includes:

a first transistor having first, second and control electrodes, said second electrode being coupled to a terminal at which is supplied ground reference potential, said control electrode being said input of said first unity gain comparator means;

a second transistor having first, second and control electrodes, said first electrode being coupled to said output of said first unity gain comparator means, said second electrode being coupled to a second terminal at which is supplied a source of operating potential, said control electrode being coupled to said first electrode of said first transistor; and first current source means coupled to said first and control electrodes of said first and second transistors respectively for supplying current thereto.

7. The stall circuit of claim 6 wherein said diode means includes a third transistor having a first, second and control electrode, said first electrode being coupled to said output of said first unity gain comparator means, said control electrode being coupled to said first circuit node, said second electrode being coupled to a second current source means for sourcing current to said third transistor when said third transistor is rendered conductive.

8. The stall circuit of claim 7 wherein said second unity gain comparator means includes:

a fourth transistor having first, second and control electrodes, said first electrode being coupled to said output thereof, said control electrode being connected to said second electrode to said first circuit node and said second electrode being coupled to a third current source means;

a fifth transistor having first, second and control electrodes, said first electrode being coupled to said output of said unity gain comparator means, said second electrode being coupled to a source of operating potential; and said third current source means having an output coupled both to said control electrode of said fifth transistor and to said second current source means wherein said fifth transistor is rendered less conductive whenever said second current source means is rendered active to source current to said third transistor.

9. The stall circuit of claim 8 wherein said first circuit means includes:

a source of fixed potential for supplying a substantially constant potential at an output thereof; and a sixth transistor having first, second and control electrodes, said first electrode being coupled to said output of said source of fixed potential, said second electrode being coupled to said output of said third current source means, said control electrode being coupled to said first circuit node.

10. The stall circuit of claim 9 including second circuit means coupled between said second current source means and the current limiting circuit which is enabled by said third transistor being rendered conductive for inhibiting the current limiting circuit, said second circuit means being responsive to said third transistor becoming non-conductive for enabling the current limiting circuit to provide current flow to the ignition coil in timed relationship to the timing signals supplied to the ignition coil.

* * * * *